US005603142A

United States Patent [19]

Dubach et al.

[11] Patent Number: 5,603,142

[45] Date of Patent: Feb. 18, 1997

[54] FRAME HINGE

[75] Inventors: Fredi Dubach, Adetswil, Switzerland; Erich Röck, Höchst, Austria

[73] Assignee: Julius Blum Gesellschaft m.b.H., Hochst, Austria

[21] Appl. No.: 558,479

[22] Filed: Nov. 16, 1995

[30] Foreign Application Priority Data

Nov. 17, 1994 [AT] Austria ..... 2128/94

[51] Int. Cl.[6] ..... E05D 7/04

[52] U.S. Cl. ..... 16/247; 16/235; 16/237; 16/246

[58] Field of Search ..... 16/235, 236, 237, 16/238, 243, 245, 246, 247, 382

[56] References Cited

U.S. PATENT DOCUMENTS

| | | | |
|---|---|---|---|
| 3,772,735 | 11/1923 | Lautenschlaeger | 16/237 |
| 4,290,167 | 9/1981 | Lautenschläger . | |
| 4,385,416 | 5/1983 | Brüstle et al. . | |
| 4,411,045 | 10/1983 | Röck et al. . | |
| 4,680,830 | 7/1987 | Rock et al. | 16/246 |
| 4,799,289 | 1/1989 | Grass | 16/236 |

FOREIGN PATENT DOCUMENTS

| | | |
|---|---|---|
| 369490 | 1/1983 | Austria . |

OTHER PUBLICATIONS

Co–pending U.S. Application Serial No. 08/558,477, filed Nov. 16, 1995, Erich Röck et al., entitled "Frame Hinge".

*Primary Examiner*—Chuck Y. Mah
*Attorney, Agent, or Firm*—Wenderoth, Lind & Ponack

[57] ABSTRACT

A frame hinge has a hinge arm which may be secured to a furniture frame and a hinge pot which may be set in a door leaf and is connected to the hinge arm on the frame side by way of at least one articulation pin. The hinge arm is secured to a first wedge plate which, together with a second wedge plate having a wedge surface or wedge surfaces facing in a direction opposite to a wedge surface or surfaces of the first wedge plate, is arranged between the hinge arm and the furniture frame. One of the two wedge plates is movable relative to the other by a Phillips screwdriver.

23 Claims, 8 Drawing Sheets

FRAME HINGE

BACKGROUND OF THE INVENTION

The invention relates to a frame hinge having a hinge arm which may be secured to a furniture frame and a hinge pot which may be set in a door leaf and is connected to the hinge arm on the frame side by way of at least one articulation pin. The hinge arm is arranged on a first wedge plate which, together with a second wedge plate having a wedge surface or wedge surfaces facing in a direction opposite to a wedge surface or surfaces of the first wedge plate, is located between the hinge arm and the furniture frame. One of the two wedge plates is movable relative to the other.

Items of furniture are known, sold in particular in the USA, which have such thin side walls that no furniture fittings can be mounted thereon. Such item of furniture is provided at the front with a frame which carries furniture fittings, for example hinges and supporting rails for pull-out guide assemblies. Conventional hinges cannot be mounted on a frame of this the, since they project too far into the furniture. For items of furniture of this type, suitable frame hinges have been developed.

SUMMARY OF THE INVENTION

It is the object of the invention to provide an improved frame hinge of the type mentioned above and by use of which it is easier to adjust the position of the door leaf, in particular in the direction of the width of the door joint. Advantageously, it should be possible to adjust the door leaf in three dimensions.

Such object of the invention is achieved in that one of the wedge plates has a receiver for an adjusting tool and the other wedge plate has latching means on which the adjusting tool acts, with the result that such other wedge plate is movable by the adjusting tool. Advantageously, latching means comprises teeth and the adjusting tool comprises a screwdriver. In this way, for adjusting the hinge arm, the person carrying out assembly can use the tool which in any case is needed to assemble the hinge.

BRIEF DESCRIPTION OF THE DRAWINGS

Various embodiments of the invention will be described in detail below with reference to the attached drawings.

In the drawings.

DETAILED DESCRIPTION OF THE INVENTION

Figure 1:
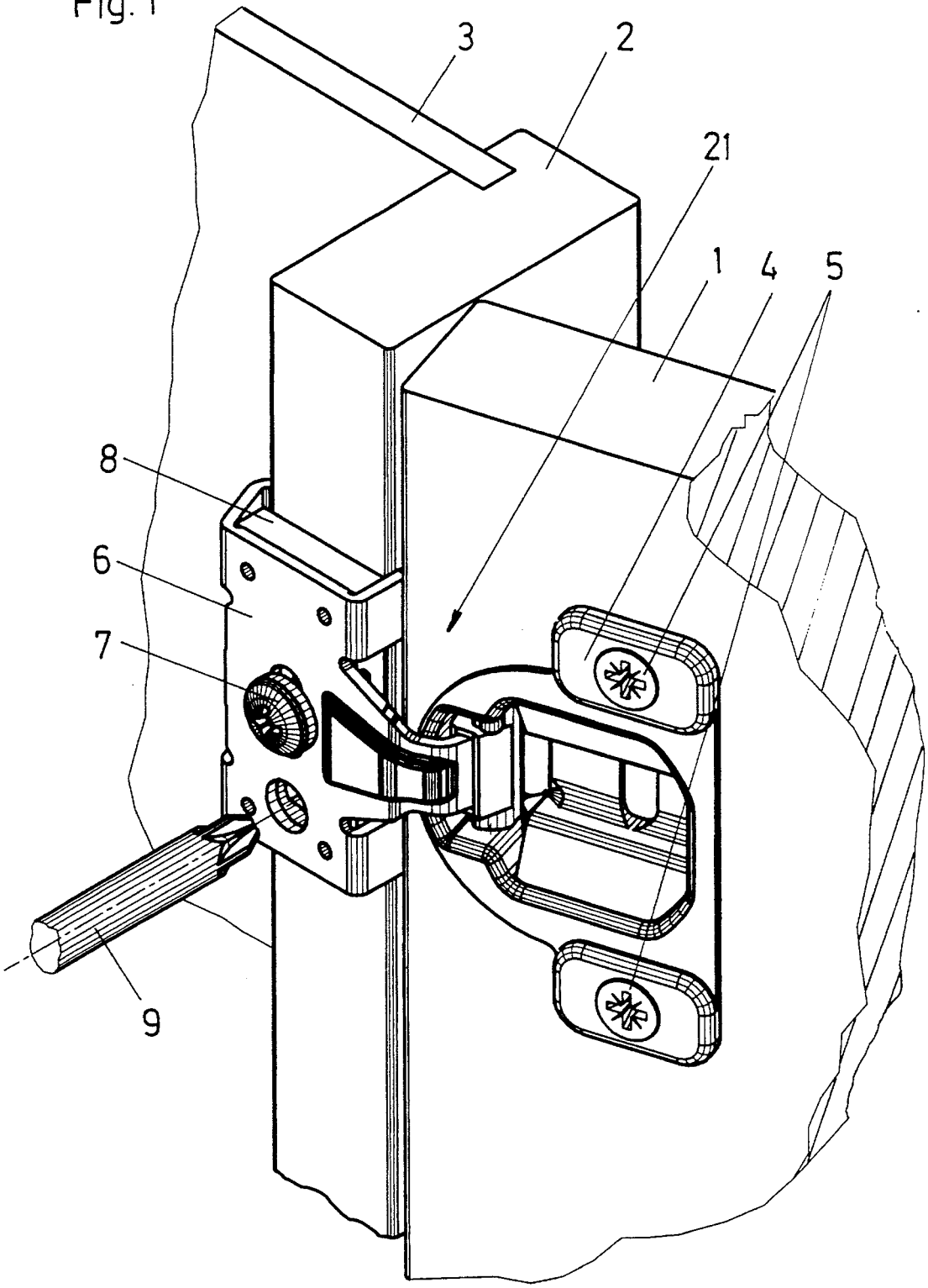
FIG. 1 is a perspective view of a frame and a door portion having mounted thereon a hinge according to the invention.
Figure 2:
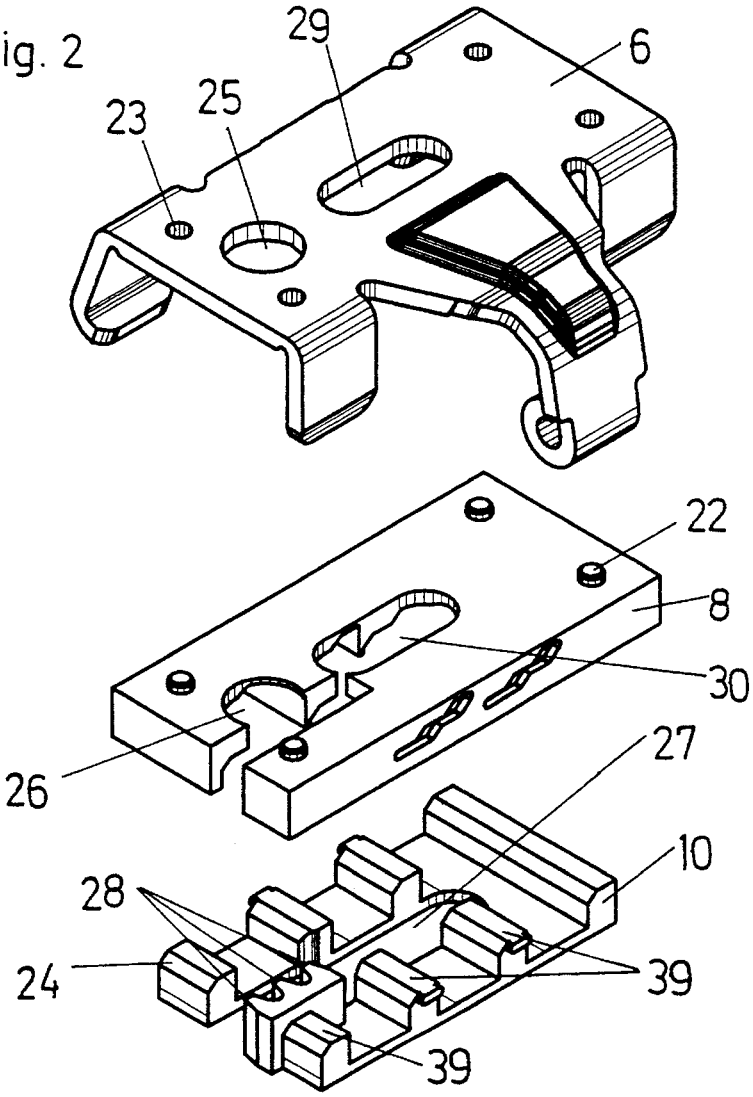
FIG. 2 is an exploded view of a hinge arm and two wedge plates.
Figure 3:
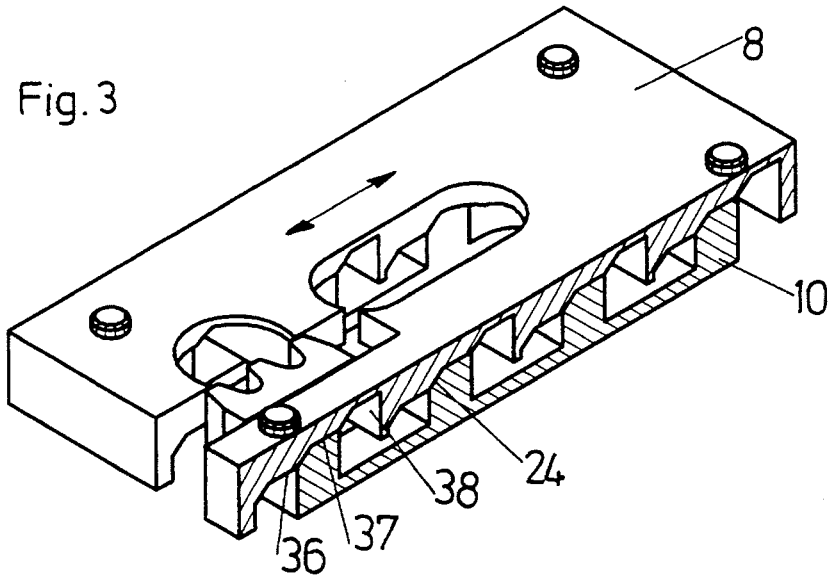
FIG. 3 is a perspective view of the two wedge plates in a joined state and partly in section.
Figure 6:
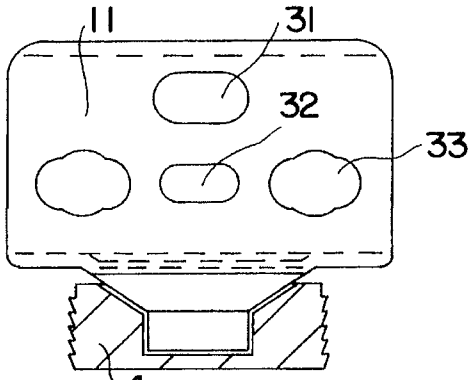
FIG. 6 is a plan view of a hinge arm thereof.
Figure 9:
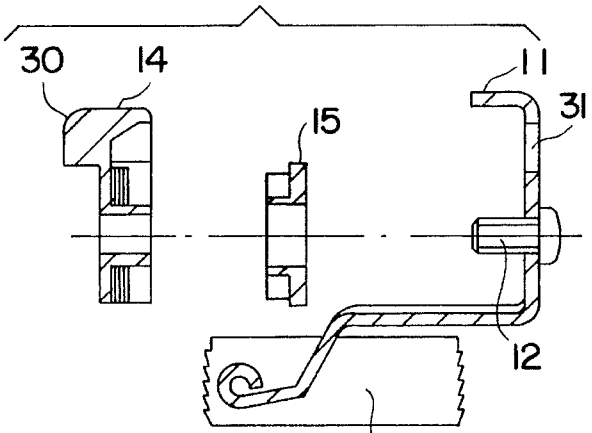
FIG. 9 is an exploded sectional view of the hinge arm and the two wedge plates.
Figure 5:
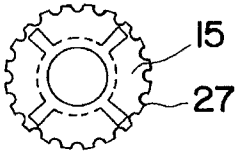
FIG. 5 is a plan view of a movable wedge plate thereof.
Figure 8:
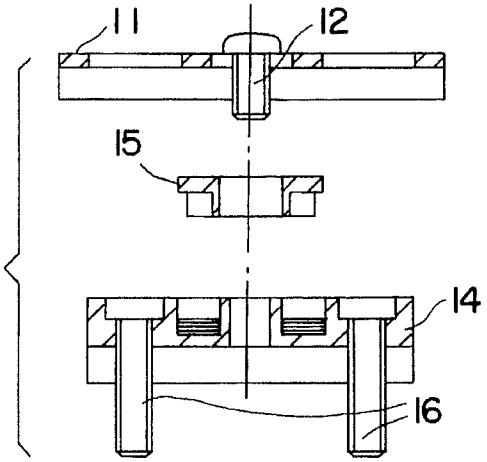
FIG. 8 is an exploded sectional view of the two wedge plates and the hinge arm.
Figure 4:
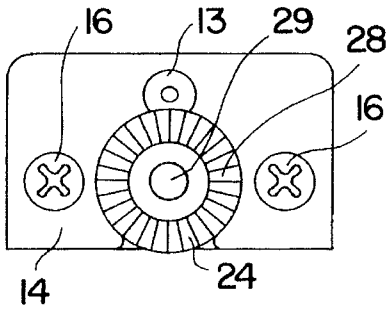
FIG. 4 is a plan view of a fixed wedge plate of a further embodiment of the invention.
Figure 7:
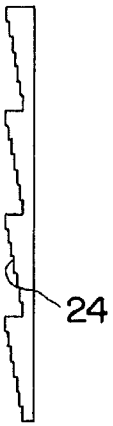
FIG. 7 is a side view of wedge surface regions of both wedge plates, shown flat.
Figure 10:
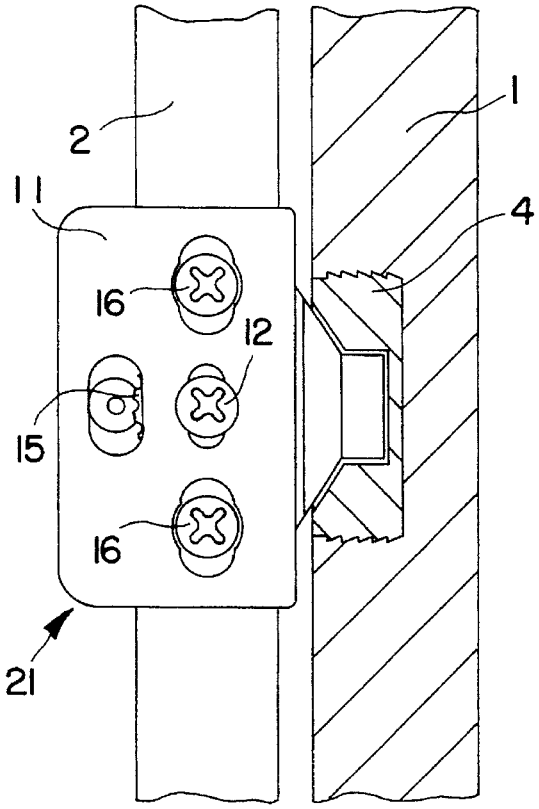
FIG. 10 is a side view of the frame hinge.
Figure 11:
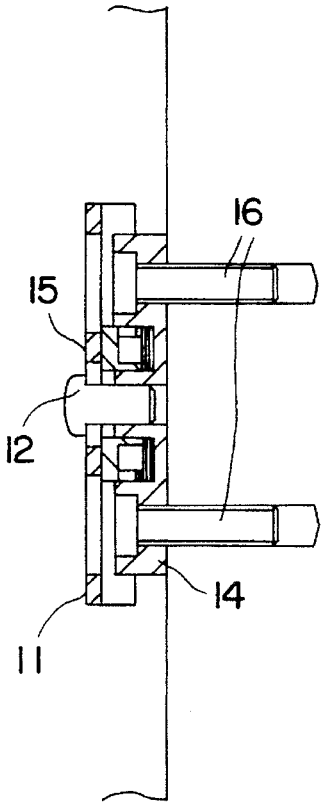
FIG. 11 is a partial vertical section through the frame hinge.

In the embodiment of FIGS. 1–3, a furniture frame 2 carries both a furniture side wall 3 and a door leaf 1. The door leaf 1 is supported on the furniture frame 2 by means of frame hinges 21. Each frame hinge 21 has a hinge pot 4 which may be set in a bore in the door leaf 1 and may be fixed to the door leaf 1 by means of securing screws 5. The hinge pot 4 is connected to a hinge arm 6 by way of an articulation pin. The hinge arm 6 is supported on the furniture frame 2 and is fixed thereto by means of a securing screw 7.

Between the hinge arm 6 and the furniture frame 2 are two wedge plates 8 and 10. Both wedge plates 8, 10 are rectangular in plan view. The wedge plate 8 closer to the hinge arm 6 is constructed as a fixed wedge plate and has lugs 22 which project into corresponding holes 23 in the hinge arm 6, with the result that wedge plate 8 is fixedly connected to the hinge arm 6.

Arranged between the fixed wedge plate 8 and the furniture frame 2 is wedge plate 10 that is movable. Both wedge plates 8, 10 have mutually corresponding wedge surfaces 24. If the wedge plate 10 is displaced relative to the wedge plate 8 in the direction of the double-headed arrow in FIG. 3, then the wedge plate 8 and thus the hinge arm 6 is either moved towards the furniture frame 2 or away therefrom. In this way, the door leaf 1 is adjusted in the direction of the width of the furniture door joint.

So that the wedge plate 10 can be adjusted by means of a Phillips screwdriver 9, the hinge arm 6 is provided with an opening 25 and the fixed wedge plate 8 is provided with a corresponding opening 26. The opening 26 forms a receiver for a tool, e.g. Phillips screwdriver 9, which is inserted therein during adjustment. The movable wedge plate 10 has an open slot 27, a latching means in the form of teeth 28 being constructed on an edge thereof. The Phillips screwdriver 9 acts on the teeth 28 and can thus, when it is turned, move the wedge plate 10 in the directions of the double-headed arrow in FIG. 3. The wedge plate 8 has three steps 36, 37, 38 against which surfaces 39 of the wedge plate 10 bear. Three groups of steps 36, 37, 38 and three plinths or projections with surfaces 39 are provided. The difference between the steps 36, 37, 38 is in each case 1/16 inch, with the result that the hinge arm 6 is raised or lowered by 1/16 inch when the wedge plate 10 is moved from one step 36, 37, 38 to the next step 36, 37, 38.

The securing screw 7 projects through an elongate hole 29 in the hinge arm 6, through an elongated hole 30 in the wedge plate 8 and through the slot 27 in the wedge plate 10. It goes without saying that to adjust the gap, that is to say to move the wedge plate 10, the securing screw 7 must be loosened. Once the gap has been adjusted, the securing screw 7 is tightened and the hinge arm 6 and thus the door leaf 1 are fixed in the desired position.

In the embodiment according to FIGS. 4 to 13, a fixed wedge plate 14 is secured to the furniture frame 2 by means of securing screws 16. A movable wedge plate 15 is constructed as an annular plate. The fixed wedge plate 14 has a corresponding ring 28 with wedge surfaces 24. The periphery of the movable wedge plate 15 is provided with latching means in the form of teeth 27. The fixed wedge plate 14 has a receiver 13, e.g. a recess, for receiving Phillips screwdriver 9.

Figure 12:
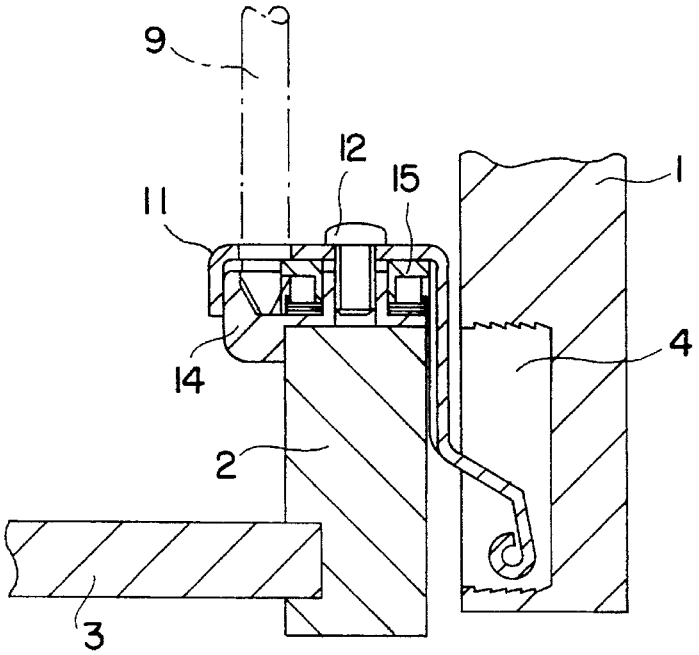
FIG. 12 is a cross-section through the frame hinge.
Figure 13:
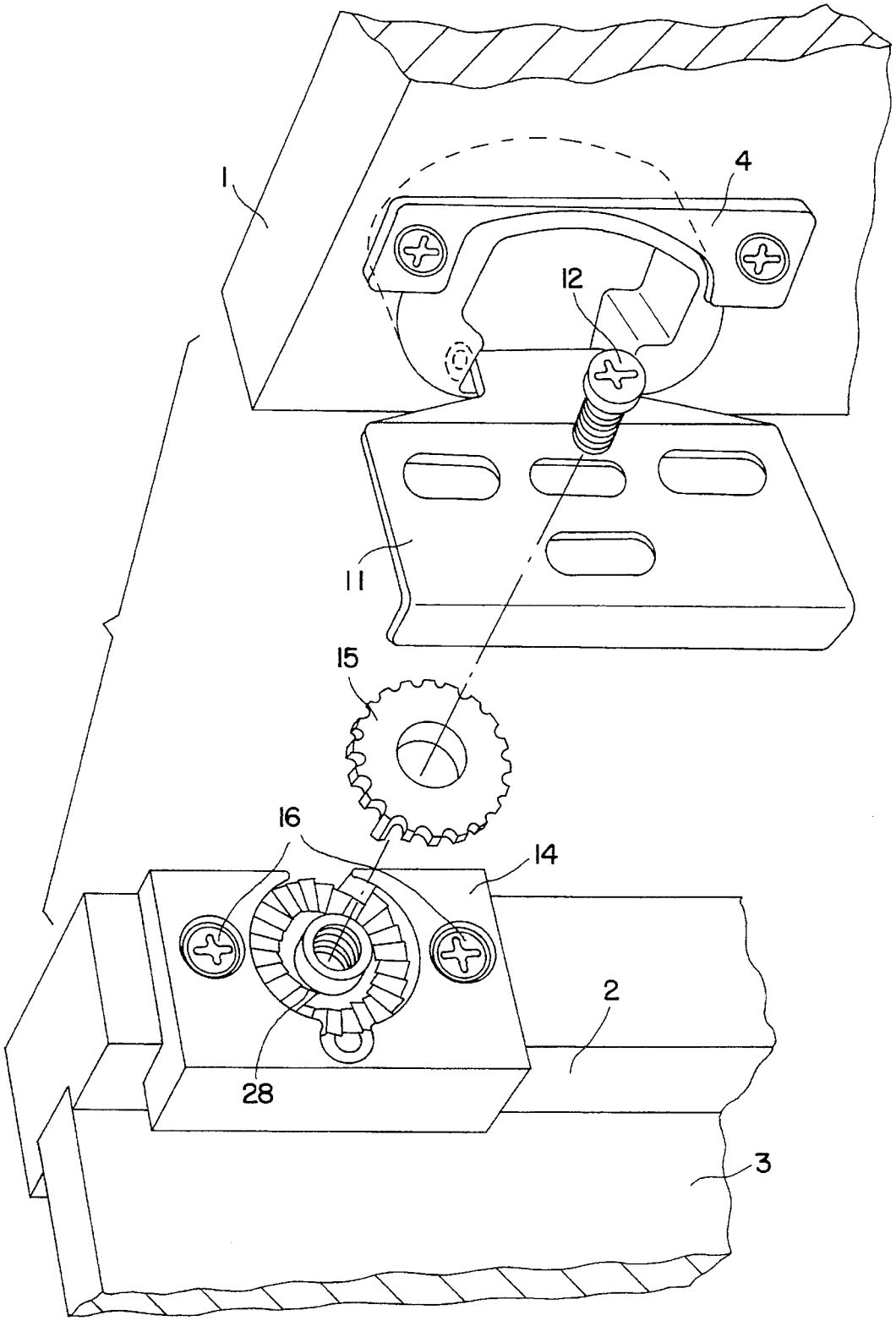
FIG. 13 is an exploded view of the parts of such hinge.
Figure 19:
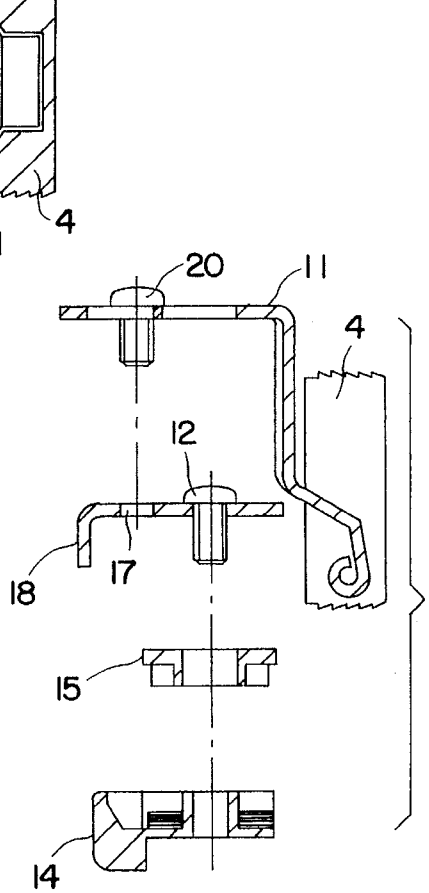
FIG. 19 is an exploded section through the parts shown in FIGS. 14 to 17.
Figure 16:
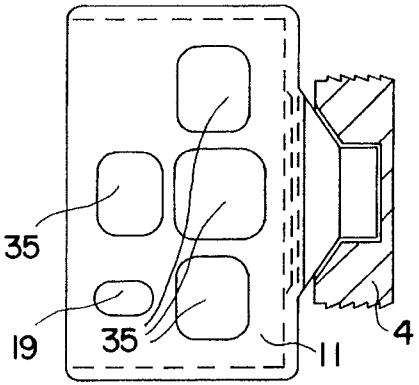
FIG. 16 is a plan view of a hinge arm.
Figure 15:
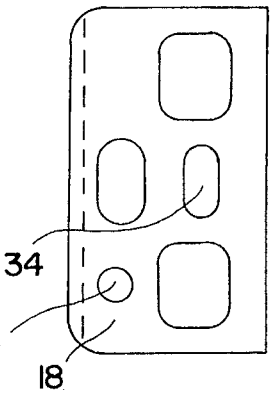
FIG. 15 is a plan view of an intermediate plate.
Figure 14:
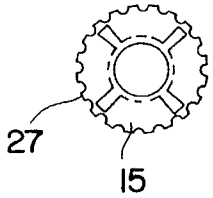
FIG. 14 is a plan view of a movable wedge plate of a further embodiment of the frame hinge according to the invention.
Figure 18:
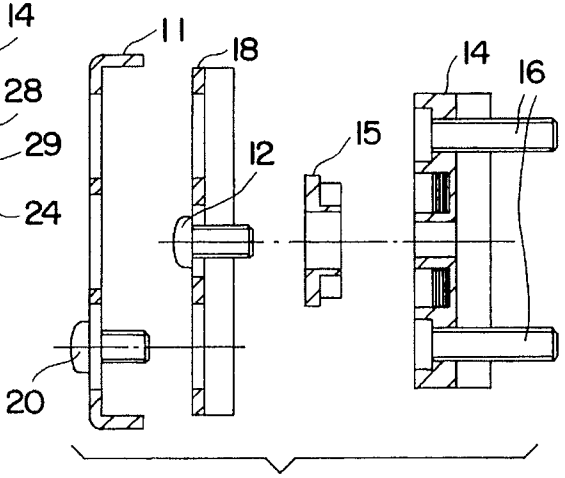
FIG. 18 is an exploded vertical section through the parts shown in FIGS. 14 to 17.
Figure 17:
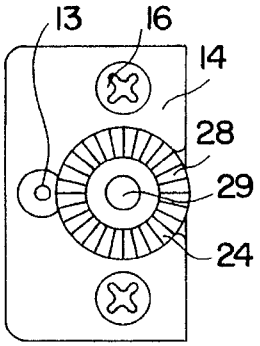
FIG. 17 is a plan view of a fixed wedge plate.
Figure 20:
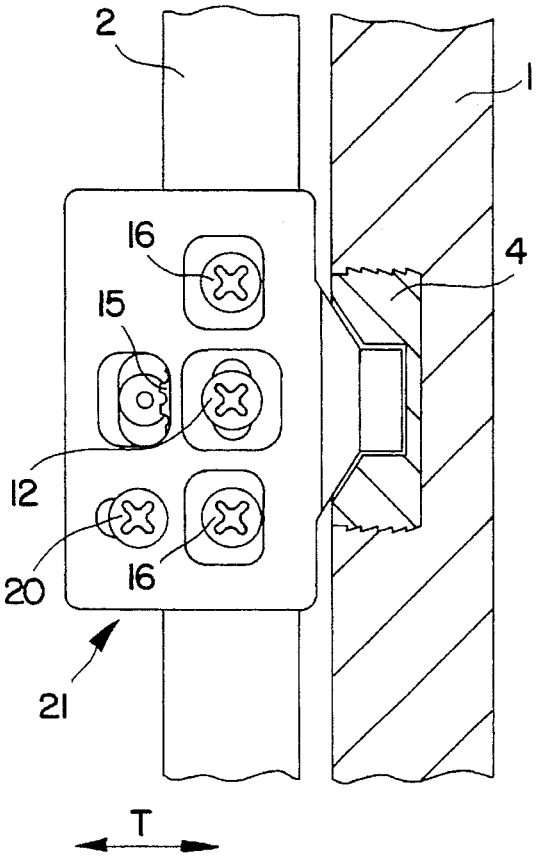
FIG. 20 is a plan view of a frame hinge according to a further embodiment of the invention.
Figure 21:
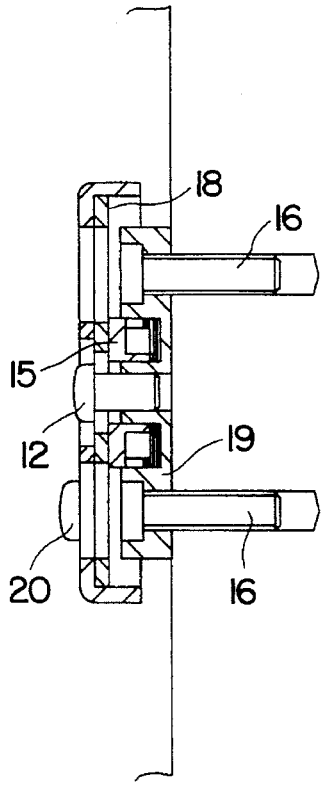
FIG. 21 is a vertical section through the parts of such frame hinge which are secured toga furniture frame.
Figure 22:
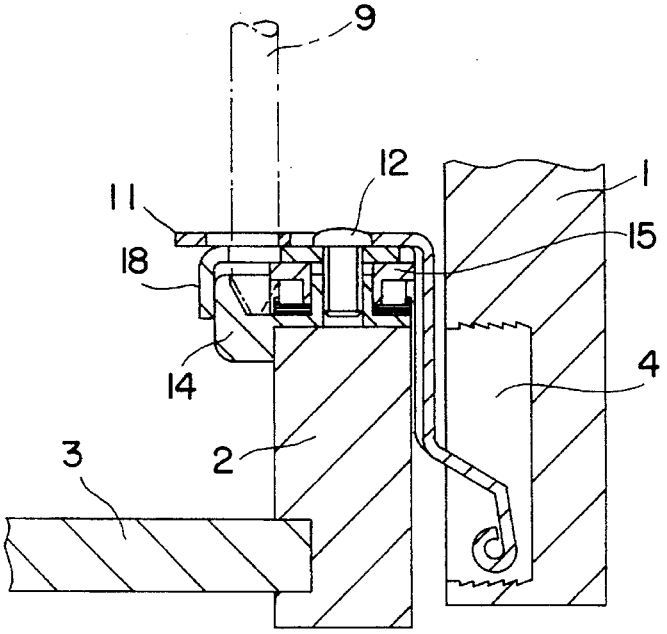
FIG. 22 is a cross-section through such hinge.
Figure 23:
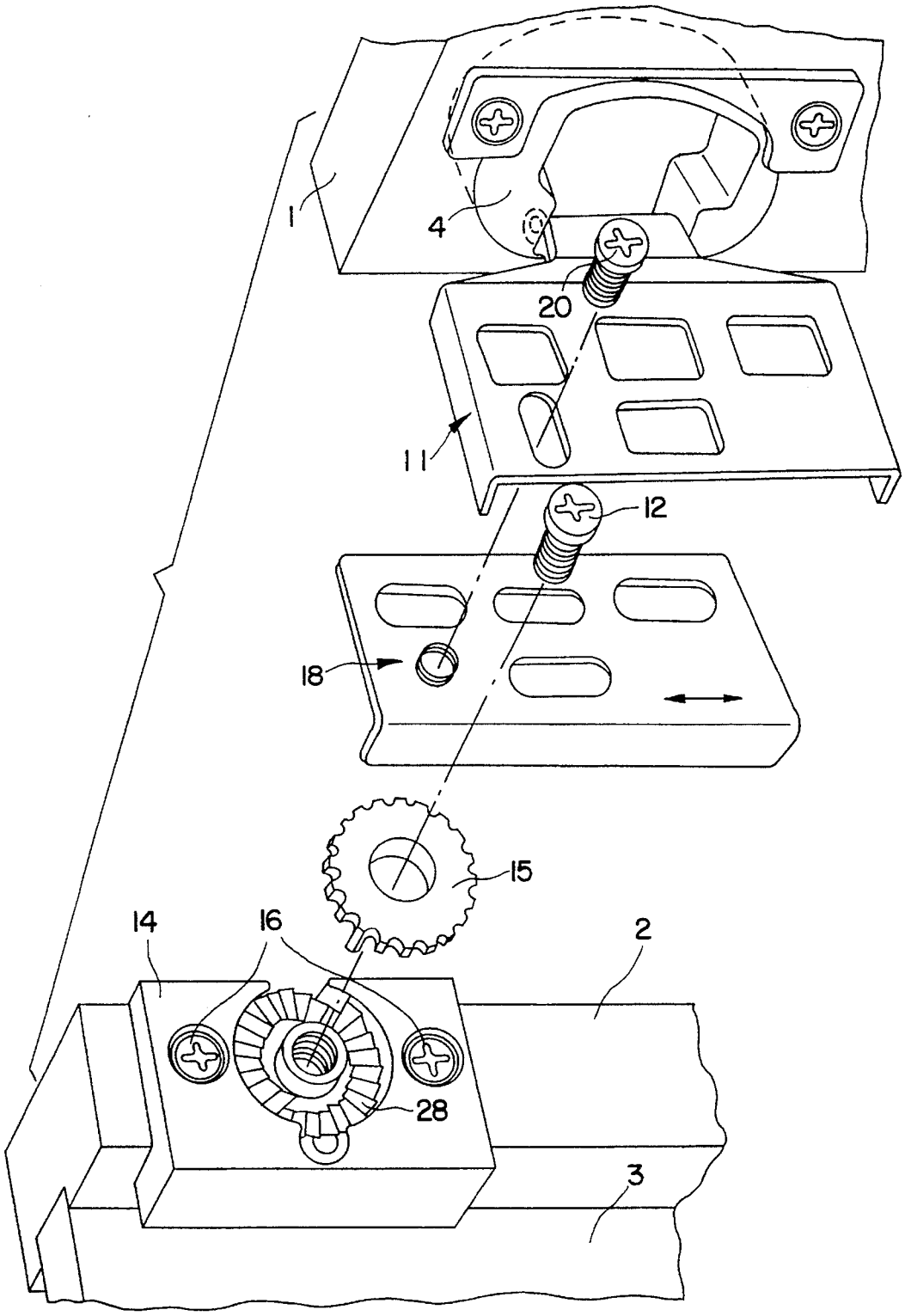
FIG. 23 is an exploded view of such hinge.

In the middle of the ring 28 of the wedge surfaces 24 there is a female thread 29 in which, in the embodiment according to FIG. 4 to 13, is threaded a securing screw 12 for the hinge arm 11. The securing screw 12 in this case projects through the ring formed by the movable wedge plate 15. The fixed wedge plate 14 is constructed to be L-shaped, as can be seen from FIG. 9, and has a marginal web 30 that bears laterally against the furniture frame 2 as shown in FIG. 12.

When the position of the door leaf 1 is adjusted, the fixed wedge plate 14, which serves as a base plate for hinge arm 11, is fixed to the furniture frame 2 by means of the screws 16. The securing screw 12 is loosened. The Phillips screwdriver 9 projects through a slot 31 in the hinge arm 11, and its tip is inserted in the receiver 13. In this position, it is possible to turn the movable wedge plate 15 by turning the Phillips screwdriver 9, since the Phillips screwdriver 9 meshes with the teeth 27 of the wedge plate 15. By turning the wedge plate 15, either the wedge plate 15 is lifted, together with the hinge arm 11, away from the furniture frame 2, or the hinge arm 11 can be pushed closer to the furniture frame 2, or the hinge arm 11 can be pushed closer to the furniture frame 2, together with the wedge plate 15. In this way, the width of the furniture door joint can be adjusted. Once the gap has been adjusted, the securing screw 12 is tightened, the wedge plates 14, 15 and the hinge arm 11 are clamped and thus the hinge arm 11 is fixed.

As well as the elongated hole 31, the hinge arm 11 has elongated holes 32 and 33. The securing screw 12 projects through the elongate hole 32. The elongate holes 33 allow a screwdriver access to the securing screws 16. The elongated holes 31, 33, 33 make it possible to move the hinge arm 11 and thus the door leaf 1 vertically relative to the furniture frame 2.

The embodiment according to FIGS. 14 to 23 differs from the embodiment described above in that an additional intermediate plate 18 is arranged between the hinge arm 11 and the movable wedge plate 15. The fixed wedge plate 14 is fixed to the furniture frame 2 by means of securing screws 15, as in the embodiment described above, and has a ring 28 with wedge surfaces 24, and a receiver 13 for the Phillips screwdriver 9. In the middle of the ring 28 of the wedge surfaces 24 is a female thread 29 in which the securing screw 12 is threaded.

In this embodiment, the securing screw 12 does not directly carry the hinge arm 11, but rather carried intermediate plate 18. The intermediate plate 18 has a female thread 17 in which a further securing screw 20 is threaded, holding the hinge arm 11 clamped to intermediate plate 11. The securing screw 20 in this case projects through an elongated hole 19 in the hinge arm 11.

By turning the movable wedge plate 15, it again is possible to adjust the spacing of the hinge arm 11, together with the intermediate plate 18, from the furniture frame 2. Once such spacing or gap has been adjusted, the securing screw 12 is tightened. If the frame hinge 21 and thus the door leaf 1 are to be adjusted in the direction of the depth of the furniture, the securing screw 20 is loosened, as a result of which the hinge arm 11 can be moved relative to the intermediate plate 18 and thus also relative to the wedge plates 14, 15 in the direction of the depth of the furniture, that is to say in the direction of the double-headed arrow T in FIG. 20. The hinge arm 11 and the door leaf i are adjusted vertically of the furniture by releasing the securing screw 12 and by moving the intermediate plate 18 and the hinge arm 11 over the length of elongated hole 34 in the intermediate plate 18. Openings 35 in the hinge arm 11 allow a tool, for example the Phillips screwdriver 9, access to the securing screws 16, the securing screw 12 and the movable wedge plate 15.

We claim:

1. A frame hinge comprising:

a hinge pot to be mounted on a door leaf;

a hinge arm to be mounted on a furniture frame and connected to said hinge pot by at least one articulation pin;

first and second wedge plates each having at least one wedge surface, said first and second wedge plates being positionable at a location between said hinge arm and the furniture frame with respective said wedge surfaces directed in opposite directions and confronting each other; and one of said wedge plates having a receiver configured to receive an adjusting tool, and the other of said wedge plates having latching means configured to be engaged by the adjusting tool such that, when the adjusting tool is received in said receiver and engaged with said latching means, the adjusting tool may be manipulated to move said other wedge plate relative to said one wedge plate along said confronting wedge surfaces thereof.

2. A frame hinge as claimed in claim 1, wherein said latching means comprise teeth configured to be engaged by a screwdriver as the adjusting tool.

3. A frame hinge as claimed in claim 2, wherein said teeth are configured to be engaged by a Phillips screwdriver as the adjusting tool.

4. A frame hinge as claimed in claim 2, wherein said teeth are at an edge of a slot formed in said other wedge plate.

5. A frame hinge as claimed in claim 4, further comprising a securing screw to be screwed into the furniture frame, said securing screw projecting through aligned elongated holes in said hinge arm and in said one wedge plate and through said slot in said other wedge plate.

6. A frame hinge as claimed in claim 1, wherein said receiver comprises a hole in said one wedge plate.

7. A frame hinge as claimed in claim 1, wherein said receiver comprises a recess in said one wedge plate.

8. A frame hinge as claimed in claim 1, wherein a first said wedge plate has steps against which bear surfaces of a second said wedge plate.

9. A frame hinge as claimed in claim 1, wherein said hinge arm is separate from said pair of wedge plates and has a U-shaped configuration enclosing said pair of wedge plates.

10. A frame hinge as claimed in claim 1, wherein a first said wedge plate is anchored to said hinge arm by lugs.

11. A frame hinge as claimed in claim 10, wherein said first wedge plate comprises said one wedge plate.

12. A frame hinge as claimed in claim 10, wherein said lugs are integral with said first wedge plate and fit into holes in said hinge arm.

13. A frame hinge as claimed in claim 1, wherein each said wedge plate has plural wedge surfaces.

14. A frame hinge as claimed in claim 1, wherein said other wedge plate comprises a circular plate, said latching means comprises teeth on an edge of said circular plate, and said circular plate has an annular arrangement of wedge surfaces.

15. A frame hinge as claimed in claim 14, wherein said one wedge plate has an annular arrangement of wedge surfaces and a female thread formed centrally thereof.

16. A frame hinge as claimed in claim 15, further comprising a securing screw threaded into said female thread and securing said hinge arm to said one wedge plate.

17. A frame hinge as claimed in claim 16, wherein said securing screw extends through a central hole in said circular plate.

18. A frame hinge as claimed in claim 15, further comprising an intermediate plate positioned between said hinge arm and said circular plate.

19. A frame hinge as claimed in claim 18, further comprising a securing screw threaded into said female thread and securing said intermediate plate to said one wedge plate.

20. A frame hinge as claimed in claim 19, wherein said securing screw extends through a central hole in said circular plate and an elongated hole in said intermediate plate.

21. A frame hinge as claimed in claim 19, further comprising another securing screw extending through an elongated hole in said hinge arm and threaded into a threaded hole in said intermediate plate, thereby clamping said hinge arm to said intermediate plate.

22. A frame hinge as claimed in claim 1, wherein said one wedge plate comprises a base plate for said hinge arm and is fixable by securing screws to the furniture frame.

23. A frame hinge as claimed in claim 22, wherein said one wedge plate is L-shaped and has surfaces to bear against two intersecting surfaces of the furniture frame.

* * * * *